US006163959A

United States Patent [19]

Arraitz et al.

[11] Patent Number: 6,163,959

[45] Date of Patent: Dec. 26, 2000

[54] METHOD OF REDUCING THE GAP BETWEEN A LINER AND A TURBINE DISTRIBUTOR OF A TURBOJET ENGINE

[75] Inventors: Anne-Marie Arraitz, Nandy; Eric Stéphan Bil, Chartrettes; Michel Gérard Paul Hacault, Massy; Laurent Philippe Yves Leray, Le Mee sur Seine; Michel Jean Loubet, Chatellerault; Marc Roger Marchi, Le Mee; Jean Manuel Morcillo, Sartrouville; Didier Marie Mortgat, Combs la Ville; Michel Jean-Pierre Pernot, Fontenay; Thierry Christian Sanz, La Garenne-Colombes, all of France

[73] Assignee: Societe Nationale d'etude et de Construction de Moteurs d'Aviation "S.N.E.C.M.A.", Paris, France

[21] Appl. No.: 09/272,774

[22] Filed: Mar. 19, 1999

[30] Foreign Application Priority Data

Apr. 9, 1998 [FR] France ..... 98 04423

[51] Int. Cl.[7] ..... B23P 15/00

[52] U.S. Cl. ..... 29/889.1; 29/889.2

[58] Field of Search ..... 29/889.2, 889.1, 29/889

[56] References Cited

U.S. PATENT DOCUMENTS

| | | | |
|---|---|---|---|
| 3,850,544 | 11/1974 | Ciokajlo . | |
| 4,183,207 | 1/1980 | Libertini . | |
| 4,987,736 | 1/1991 | Ciokajlo et al. . | |
| 5,205,708 | 4/1993 | Plemmons et al. | 29/889.2 |
| 5,279,031 | 1/1994 | Carruthers et al. | 29/889.2 |
| 5,438,756 | 8/1995 | Halchak et al. | 29/889.2 |

*Primary Examiner*—I. Cuda

*Attorney, Agent, or Firm*—Oblon, Spivak, McClelland, Maier & Neustadt, P.C.

[57] ABSTRACT

A method of reducing the gap between a liner and a turbine distributor of a turbojet engine. The method allows for the improvement of the seal on the inside of the distributor of the high pressure turbine at the lower platform. The method includes the steps of: applying a protective deposit to the lower part of the external surface of the liner, before carrying out a filling by diffusion brazing between the liner and the distributor. The protective deposit, preferably a anti-adherent ceramic, makes it possible for the braze to avoid fixing the liner onto the distributor at the lower platform level. The method also has applications to turbojet engines.

5 Claims, 2 Drawing Sheets

METHOD OF REDUCING THE GAP BETWEEN A LINER AND A TURBINE DISTRIBUTOR OF A TURBOJET ENGINE

BACKGROUND OF INVENTION

1. Field of the Invention

The invention relates to the high pressure turbine of a gas turbine, such as those used in turbojet engines to propel aeroplanes. More precisely, it relates to the fixing of the liner on the inside of a distributor of the high pressure turbine and, in particular to the reduction of the gap that exists between this distributor and its liner at the lower platform, so as to improve the sealing of the assembly.

The invention also relates to the partial or complete brazing of the metal components.

2. Discussion of Background

Present-day and future gas turbine engines, such as the turbojet engines which are fitted to civil and military aeroplanes are currently the subject of research aimed at improving performance and the maintenance of these turbojets. The consequences of these improvements are the provision of a reduction in fuel consumption and the maintenance costs of the engine, whether the engine is under the wing of an aircraft or in a workshop for an overhaul. Consequently, taking account of these objectives obliges aircraft engineers to reconsider the specification of certain parts of these turbojet engines. This is, in effect, the situation with regard to the seal at the lower platform of a distributor of a high pressure turbine.

SUMMARY OF THE INVENTION

The main subject of the present invention is a method to reduce the gap that exists between a high pressure turbine distributor of a turbojet engine, in the area of the lower platform and the liner that passes through such a distributor and that has to be fixed to the inside of the distributor at the top plate.

According to the present invention, the method consists of brazing the gap that exists at the lower platform without the braze touching the line. The different phases of the method are as follows:

- apply a protective deposit onto the external surface of the lower part of the liner;
- assemble the liner in the distributor;
- fix the liner into the distributor at the area of the upper part and the top plate;
- by brazing, reduce the gap between the external surface of the lower part of the liner covered with the deposit and the internal surface of the distributor in the area of the lower platform.

In the main embodiment of the method according to the invention, the reduction of the gap by brazing takes place by filling by diffusion brazing.

In this case, it is preferable to carry out the filling by the application of a bonding compound for a super-alloy comprising among other things an added element that makes it more fusible than the super-alloys.

The brazing is concluded by an operation that consists of passing the assembly into the furnace so that the compound diffuses into the gap between the liner and the distributor.

Preferably the protective deposit is a non-stick ceramic deposit of the zirconate type.

BRIEF DESCRIPTION OF THE DRAWING

The method according to the present invention are described with the help of two Figures, as follows.

DETAILED DESCRIPTION OF THE PREFERRED EMBODIMENTS

Figure 1:
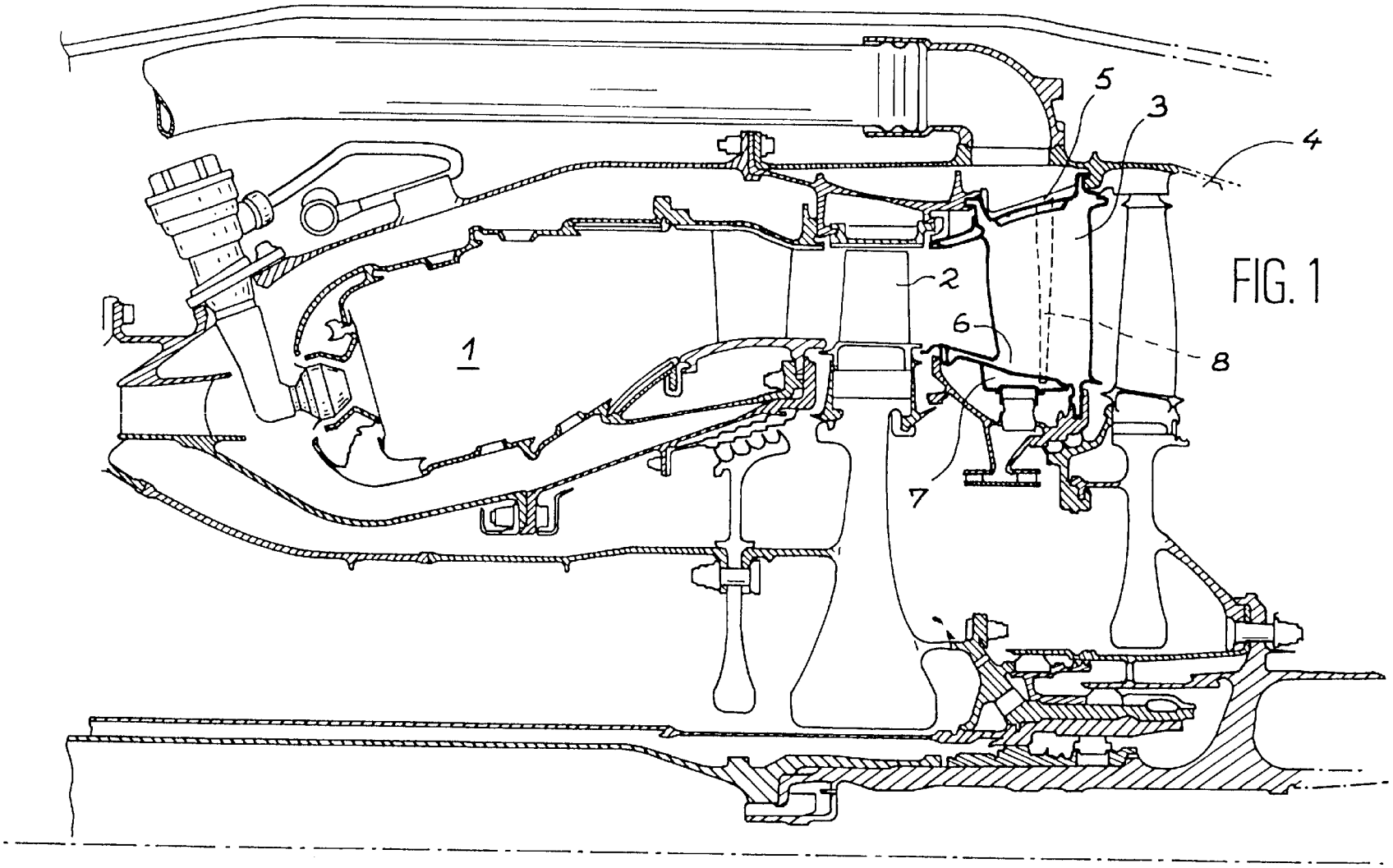
FIG. 1 is a partial longitudinal cross-sectional view of a turbojet in which the method according to the present invention bas been used.

FIG. 1 represents a partial cross-section of a turbojet in which the method according to the present invention has been used. To the left and upstream of the gas circulation path in the engine one can see the combustion chamber 1 followed by the high pressure turbine 2. At the exit of the high pressure turbine 2 and upstream of the low pressure turbine, there are a series of distributor 3, fixed on the one hand to the top plate 5, positioned between the hot channel and the cold channel and, on the other hand, to the lower platform 6, that separates the hot channel from an annular air circulation duct 7. The liner 8 allows free circulation of air or a cooling gas on both sides of the distributor 3, notably in the annular air circulation duct 7 in the region of the lower platform 6. Passing through each distributor 3, there is a conduit created by a liner 8 that opens into the air supply duct 7. This liner 8 is a constituent part of a cooling circuit for a part of the turbojet, notably the distributors and some other components.

Figure 2:
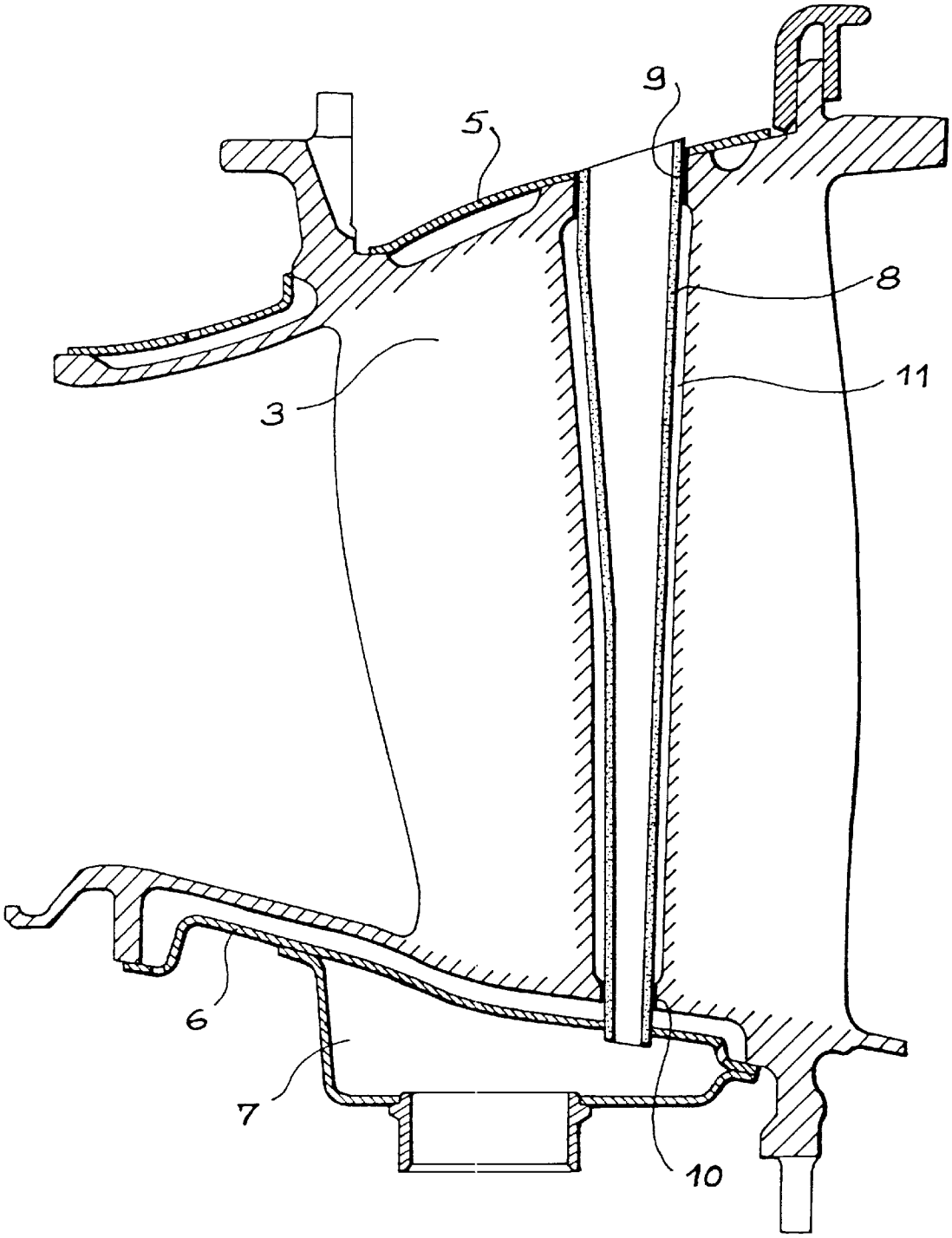
FIG. 2 is a partial cross-sectional view of a distributor of a high pressure turbine on which the method according to the present invention has been used.

FIG. 2 shows, in a more detailed way, the area where the liner 8 is to be found. That is to say, in the middle of the distributor 3, which is inclined with respect to the direction of the air flow, in such a way as to rectify the flow downstream in the direction of the low pressure turbine.

It can be seen that the liner 8 must be fixed into the distributor 3. It is fixed to its upper part by a braze 9 at the upper plate. Taking into account the well-known differences in temperature that occur during the operation of the gas turbine engine, very large expansions take place in all metal components. It is therefore necessary to allow the liner 8, a degree of freedom and not to fix it at its lower part to the lower platform 6. Because of this, there is a gap between the liner 8 and the distributor 3 at the lower platform 6.

It is well known that this gap, at the lower platform 6, impairs the seal in the area of the distributor 3 and affects, to a degree, the efficiency of the turbojet engine. The aim of the present invention is therefore to remedy this disadvantage by trying to resolve the problem of the seal in the area of the lower part of the liner 8 of the distributor 3 of a high pressure turbine.

Referring to FIG. 2 and in particular to reference number 10 representing a braze, the reduction of the gap, according to the method proposed by the invention is nevertheless carried out by brazing despite the fact that the first function of the brazing is a fixing function. However, it is essential not to braze the liner 8 onto the distributor 3, in the area of the lower platform 6, since the liner 8 is already fixed onto the stiffener at the top plate 5, by a braze 9.

Consequently, before the liner 8 is introduced into the distributor 3, a protective deposit is applied over a small height of the external surface of the liner 8 that is opposite the internal surface of the hole 11 in the distributor 3 and, which is at the lower part of the liner 8. To put it another way, the lower part of the external surface of the liner S is coated with a deposit in the area of the lower platform 6.

The only purpose of this protect,Te deposit is so that subsequent brazing does not weld or fix the liner 8 to the distributor 3. It is recommended that a nonstick ceramic type deposit is used of the zirconate type or another equivalent product. In particular, a product sold under the name NETCO 204 NS, by the company SULZER is used.

The liner 8 is then introduced into the hole 11 of the distributor 3 and is fixed at its top by a braze 9, as is shown in FIG. 2. The reduction of the gap in the area of the lower platform 6, between the external surface of the liner 8 and the hole 11 in the distributor 3 in which it has been inserted occurs through filling by diffusion brazing (RBD).

This type of filling by diffusion brazing is carried out using a compound that is applied around the lower part of the liner 8, in the area where one wishes to braze. A heat treatment must then take place for the compound to melt and to diffuse. The assembly assembled in this way is then passed into the furnace for diffusion of the compound into the gap that is to be filled. The braze 10, shown in FIG. 2 is then created without the liner being fixed in this area to the distributor 3. The compound spreads itself into the gap to be sealed through capillarity. It should be noted that preferably the compound is put into place at the time the platform 6 and the lower plate are assembled.

It will be remembered that diffusion brazing is a method that uses a paste mainly comprising a powder composed of the alloys or metals that constitute the two parts concerned in the brazing. An additive is added to this paste to make it more fusible. Generally a nickel based additive is used at a level such that its liquids temperature is lower than the solids temperature of the alloys and metals thao constitute the powder base.

Within the context of this application relating to the locating of a liner in a distributor of a turbojet, the metals that generally make up these elements are super-alloys based on nickel or cobalt.

By almost entirely getting rid of the gap that exists between the liner 8 and the distributor 3, in the area of the lower platform 6, it is possible to get rid of the leakage flow from this area. Hence the performance of the turbojet is substantially improved.

What is claimed as new and desired to be secured by Letters Patent of the United States is:

1. A method of reducing a gap that exists between a distributor of a high pressure turbine of a turbojet at a lower platform and a liner that passes through said distributor and which has to be fixed to an inside of said distributor at a top plate, said method comprising the steps of:

applying a protective deposit on an external surface of a lower part of said liner;

assembling said liner in said distributor;

fixing said liner in said distributor at an upper part; and reducing said gap, by brazing, between said external surface of said lower part of said liner coated with said protective deposit and an internal surface of said distributor in an area of said lower platform.

2. The method according to claim 1, wherein said reducing of said gap, by brazing, takes place by filling by diffusion brazing.

3. The method according to claim 2, wherein said filling takes place by applying a bonding paste for a super-alloy that comprises an additive that makes said bonding paste more fusible than super-alloys constituting said liner and said distributor.

4. The method according to claim 3, wherein after said assembling of said liner, said liner is then subjected to a heat treatment in a furnace so that said paste diffuses into said gap between said liner and said distributor.

5. The method according to claim 1, wherein said protective deposit is a non-stick ceramic deposit of a zirconate type.

* * * * *